US010299035B2

(12) United States Patent
Gladwin et al.

(10) Patent No.: US 10,299,035 B2
(45) Date of Patent: May 21, 2019

(54) ACOUSTIC LENS SYSTEM FOR LOUDSPEAKERS

(71) Applicant: Harman International Industries, Incorporated, Stamford, CT (US)

(72) Inventors: Timothy Gladwin, Pakenham (CA); Mark Glazer, Agoura Hills, CA (US); Jason Gokavi, Stamford, CT (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 15/392,645

(22) Filed: Dec. 28, 2016

(65) Prior Publication Data

US 2017/0195783 A1 Jul. 6, 2017

Related U.S. Application Data

(60) Provisional application No. 62/273,231, filed on Dec. 30, 2015.

(51) Int. Cl.

| | |
|---|---|
| ***H04R 1/34*** | (2006.01) |
| ***G10K 11/30*** | (2006.01) |
| ***H04R 1/02*** | (2006.01) |

(52) U.S. Cl.

CPC ..... *H04R 1/345* (2013.01); *G10K 11/30* (2013.01); *H04R 1/023* (2013.01); *H04R 2201/34* (2013.01)

(58) Field of Classification Search

CPC ..... H04R 1/345; H04R 1/347; H04R 1/36; H04R 1/38; H04R 2201/34; H04R 1/30; G10K 11/30

See application file for complete search history.

(56) References Cited

U.S. PATENT DOCUMENTS

| | | | | |
|---|---|---|---|---|
| 4,164,631 | A * | 8/1979 | Garner | H04R 1/345 181/176 |
| 8,672,088 | B2 | 3/2014 | Sterling et al. | |
| 8,995,697 | B2 | 3/2015 | Gladwin et al. | |
| 2011/0085691 | A1* | 4/2011 | Schultz | H04R 1/345 381/343 |
| 2011/0168480 | A1* | 7/2011 | Sterling | H04R 1/345 181/176 |
| 2013/0083537 | A1* | 4/2013 | Harwood | F21V 33/0076 362/253 |
| 2015/0172818 | A1 | 6/2015 | Gladwin et al. | |
| 2016/0227315 | A1 | 8/2016 | Kim et al. | |

* cited by examiner

*Primary Examiner* — Fan S Tsang
*Assistant Examiner* — Angelica M McKinney
(74) *Attorney, Agent, or Firm* — Brooks Kushman, P.C.

(57) ABSTRACT

An acoustic lens may improve the directional audio performance of a loudspeaker. Application of the improved directional audio performance to a sound system in a listening area may improve the performance of the audio system. The acoustic lens (or phase plug) may be acoustically opaque and partially fill the cavity formed by the loudspeaker cone. The acoustic lens may provide an improved frequency response and directivity. The improved loudspeaker may provide an improved listening location, for example, in a vehicle, a room or a concert hall.

16 Claims, 9 Drawing Sheets

EFFECT OF MIDRANGE LENS, FIRST REFLECTIONS

EFFECT OF MIDRANGE LENS, ON AXIS

EFFECT OF MIDRANGE LENS, SOUND POWER

EFFECT OF MIDRANGE LENS, WINDOW

ACOUSTIC LENS SYSTEM FOR LOUDSPEAKERS

CROSS-REFERENCE TO RELATED APPLICATIONS

This application claims the benefit of U.S. provisional application Ser. No. 62/273,231 filed Dec. 30, 2015, the disclosure of which is hereby incorporated in its entirety by reference herein.

TECHNICAL FIELD

Aspects disclosed herein generally relate to acoustic lenses, and more specifically, to loudspeakers with an acoustic lens, which may direct acoustic emissions from the loudspeaker.

BACKGROUND

The midrange in many loudspeakers may suffer from timbre defects in the acoustic output at the ends of the midrange bandwidth. The timbre defects may include peaks and dips that may result from interference, constructive or destructive, from sound radiation originating in spatially diverse areas of the diaphragm. The peaks and dips may also originate from the Helmholtz cavity resonance formed by the cone shaped diaphragm itself. Although in a speaker system, the midrange transducer operation is usually band limited with frequency limiting low pass filters to operate below the frequencies where the peaks and dips manifest themselves, such filters are necessarily tapered so that the midrange sound pressure level is attenuated by between 6-24 dB SPL/doubling of frequency. As a result, midrange timbre defects found at frequencies several times the frequency of the high pass filter may affect the overall timbre performance of the loudspeaker system.

A typical loudspeaker may have increased directivity and/or nulls in the frequency response at higher frequencies. Accordingly, the speaker will not provide the same frequency response or tonal quality for each listener depending upon the listener's relative position to the speaker. The response difference may result in reduced high frequency output at some listening positions. Additionally, the response at angles away from a primary axis of the speaker may have a different character from the response on the primary axis. Typically, the different character of the off-axis performance cannot be corrected electronically.

Automotive sound systems currently suffer from different tonal balance in different listening positions due to the directivity characteristics of direct radiating loudspeakers. Sound energy radiating into the surrounding ambient space within an automobile may result in different tonal balance characteristics depending upon the relative position of the listener to the loudspeaker.

SUMMARY

A lens assembly having an acoustic lens is described herein. The lens assembly may include a housing, an acoustic lens that is acoustically opaque, an acoustic emitter supported in the housing, and a support engaging the housing and holding the acoustic lens spaced above the acoustic emitter, wherein a front of the acoustic lens does not extend outwardly past the acoustic emitter.

In an example, the support is essentially acoustically transparent.

In an example, the acoustic emitter is a midrange transducer having a cone.

In an example, the acoustic lens is positioned in a volume defined by the cone of the midrange driver.

In an example, the front of the acoustic lens is coplanar or slightly recessed from a front of the midrange driver.

In an example, the support extends in front of a front face of the acoustic emitter to secure the acoustic lens with the acoustic lens not being attached to a cone of the acoustic emitter.

In an example, the acoustic lens substantially fills a resonant cavity formed by a loudspeaker diaphragm of the acoustic emitter while simultaneously blocking destructive interference due to differing acoustical path lengths across the loudspeaker diaphragm.

In an example, the acoustic lens is sized to reduce acoustic output from the acoustic emitter.

In an example, the acoustic lens is sized to reduce sound pressure level at specific frequencies of the acoustic emitter.

In an example, the acoustic lens is substantially disk shaped with a primary axis coaxial with the acoustic emitter.

In an example, wherein the acoustic lens is cylindrical.

In an example, the acoustic lens has a first diameter, wherein the acoustic emitter has a second diameter, and wherein the first diameter is approximately ⅓ a length of the second diameter.

In an example, the acoustic lens has a diameter of 30-45 mm for a midrange driver.

In an example, the acoustic lens has a first dimension in a range of about 25-50 mm, +/−2 mm.

In an example, the acoustic lens lies wholly between a plane defined by a maximum forward excursion of a transducer of the acoustic emitter and a plane defined by a most forward feature of a diaphragm of the acoustic emitter.

In an example, a rear surface of the acoustic lens fills a cavity created by the diaphragm while not interfering with free movement of the diaphragm.

In an example, the acoustic lens provides a clearance to a surface defined by the diaphragm for a maximum excursion of the diaphragm to allow propagation of broadband sound from the diaphragm.

A speaker assembly including any of the above examples is also described. The speaker assembly may include a dust cap coupled to a diaphragm. An acoustic lens can be coupled to the speaker assembly such that a volume is between the acoustic lens and the diaphragm. The acoustic lens may include a first surface and a second surface that unite to form an edge to define a perimeter, wherein the first surface, the second surface and the perimeter do not extend outwardly past the diaphragm. The acoustic lens may further include an effective aperture outside the perimeter to allow sound waves to emit from the speaker assembly. The acoustic lens may further include a support to suspend the acoustic lens.

In an example, the support is acoustically transparent for acoustic frequencies of the speaker assembly and is connected to a frame of the speaker assembly.

In an example, the support holds the acoustic lens coaxially above the dustcap in the diaphragm.

In an example, the support may include two arcuate legs to support the acoustic lens. The acoustic lens may provide a clearance to a surface defined by the diaphragm for a maximum excursion to allow propagation of broadband sound from the diaphragm.

BRIEF DESCRIPTION OF THE DRAWINGS

The disclosure may be better understood from reading the following description of non-limiting embodiments, with reference to the attached drawings, wherein below.

DETAILED DESCRIPTION

As required, detailed embodiments of the present invention are disclosed herein; however, it is to be understood that the disclosed embodiments are merely examples of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The present description describes lens assemblies for use in loudspeakers, e.g., stand alone loudspeakers, automotive loudspeakers, hall loudspeakers and the like. The lens assembly may be used to alter the sound quality of a loudspeaker, e.g., a midrange transducer as an acoustic emitter. The lens assembly may include an acoustic lens that is positioned in front or in a sound emitter, e.g., the midrange transducer, to shape the acoustic output of the loudspeaker.

The present description may further describe structures and methods for directing radiating loudspeakers or for modifying the directivity of sound radiation. An acoustically opaque lens may guide sound energy from a sound producing surface of an acoustic emitter (e.g., a loudspeaker), through an aperture with a smaller area than the sound producing surface of the acoustic emitter, e.g., the diaphragm. Depending upon the features of the acoustic lens, the acoustic lens may cause nulls in the response of the speaker assembly at higher frequencies or may reduce the sound pressure level at certain higher frequencies of the loudspeaker. The acoustic lens may not affect the lower frequency output of the loudspeaker.

Figure 1:
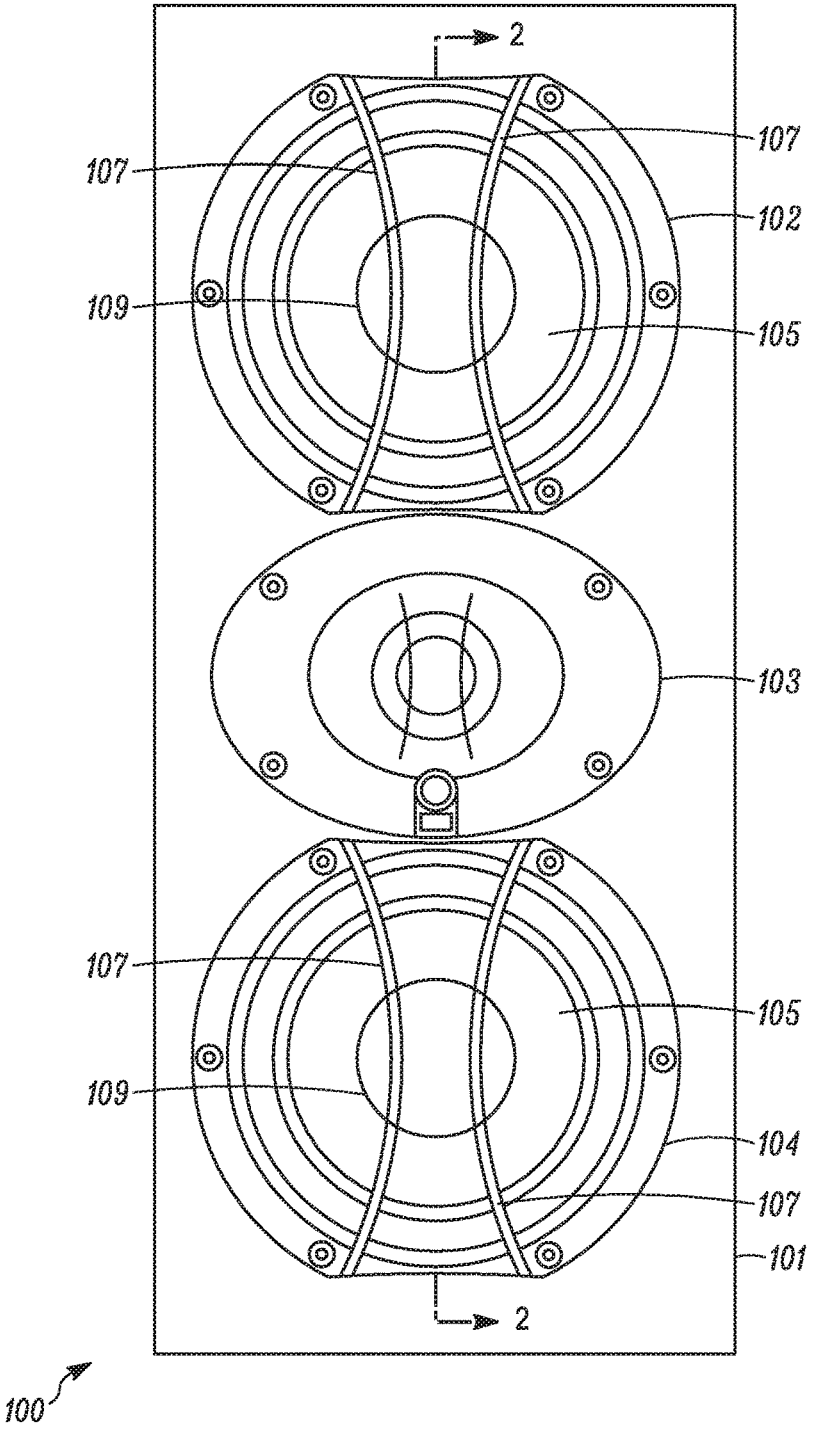
FIG. 1 depicts a loudspeaker with a lens assembly in accordance to an embodiment.

FIG. 1 depicts a loudspeaker 100 that may be used in room, hall, or vehicle. A speaker body 101 supports a plurality of acoustic emitters, e.g., transducers 102, 103, 104. The transducers 102, 104 may be mid-range transducers. The transducer 103 may be a tweeter, e.g., high frequency transducer. The transducers 102 and 104 each include an acoustic lens assembly 105. The acoustic lens assembly 105 includes a support 107 and an acoustically opaque lens 109. The support 107 is acoustically transparent. The support 107 holds the lens 109 in coaxial alignment with the remainder of the transducer 102, 104. The support 107 may include at least two arms that extend from one side of the transducer to the other side of the transducer with the lens 109 being fixed to the middle of the two arms. The arms may be arcuate with the lens 109 fixed to the apex of the arms. If the lens is circular, then a diameter may be aligned with the apex of the arms. In an example, the lens 109 is centered at the mid-length of the arms. The lens 109 may of any acoustically opaque material, e.g., a metal alloy, a polymer, a combination thereof or the like. The acoustic lens 109 may be free of apertures therethrough that allow sound to travel through the interior of the lens.

Figure 2:
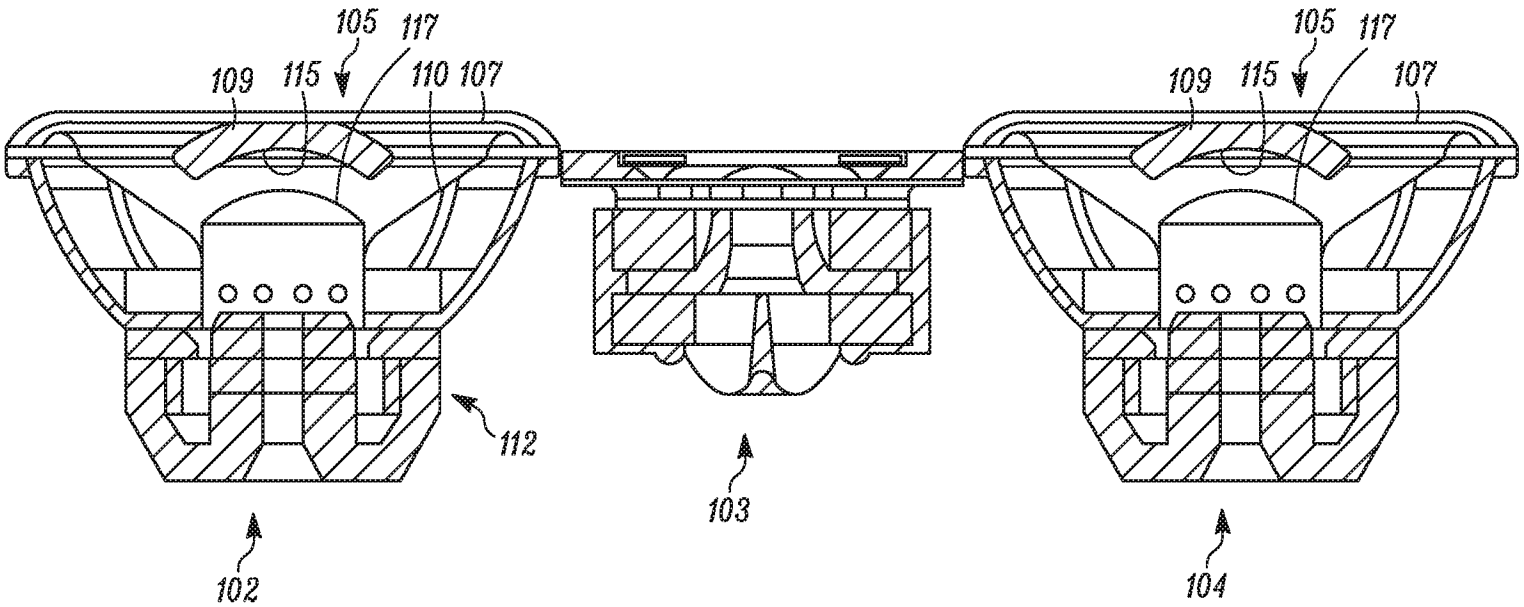
FIG. 2 depicts a cross sectional view taken generally along line 2-2 of FIG. 1 in accordance to an embodiment.

FIG. 2 depicts a cross sectional view of the loudspeaker 100. The lens 109 may have a top surface that is essentially co-planar with the outer most surface of the diaphragm 110 or frame supporting the diaphragm 110. In an example, the lens 109 does not extend past the front face of the speaker 102, 104. The diaphragm 110 extends from a frame or outer support into the volume of the cavity in a housing and is driven by electromagnetic components 112 that translate an electrical signal applied thereto into mechanical movement of the diaphragm 110. The lens 109 is positioned in the cavity defined by the diaphragm 110. The bottom surface 115 of the lens 109 is adjacent a central dust cap 117. The diaphragm 110 may be curved to match the dust cap 117 on the center part of the transducer electromagnetic components 112. Details of the electromagnetic components are explained with greater detail below. A side surface of the lens 105 extends from the top surface 109 to the bottom surface 115. The lens side surface is smoothly curved with no sharp angles or any ninety degree angles. The lens 109 will have a dimension greater than the transducer electromagnetic components 112 or to at least a dimension to extend radially above an inner part of the diaphragm 110.

Figure 3:
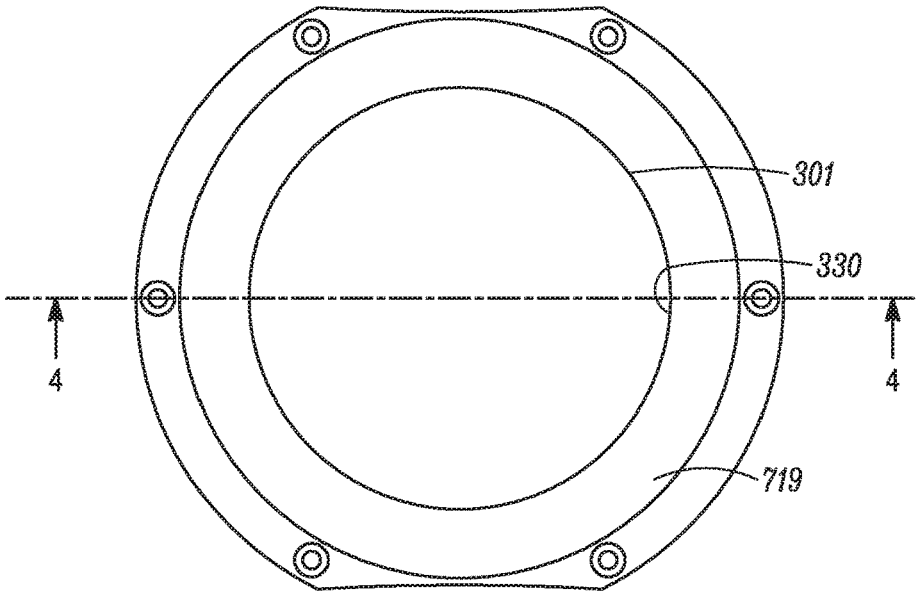
FIG. 3 depicts a front view of a loudspeaker.
Figure 4:
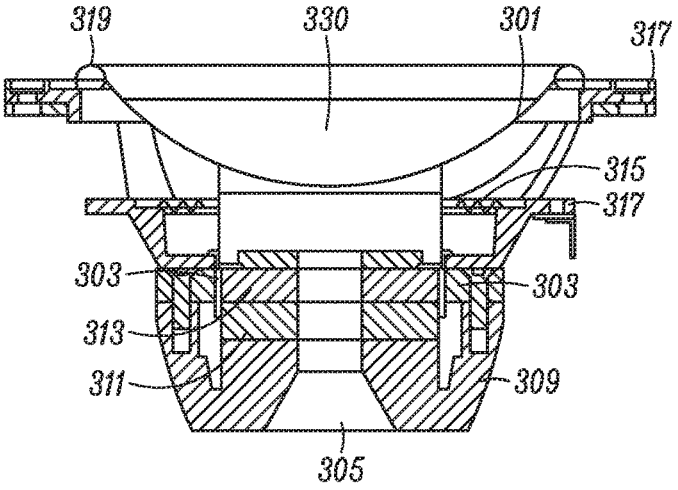
FIG. 4 depicts a cross sectional view taken generally along line 4-4 of FIG. 2.

FIG. 3 depicts a front view of a loudspeaker part 300, which may be a midrange driver or transducer. FIG. 4 depicts a cross sectional view of the loudspeaker part 300 taken generally along line 4-4 in FIG. 3. The loudspeaker part 300 may include a transducer. The loudspeaker part 300 includes a diaphragm 301 attached at the periphery of its center opening to a voice coil 703, so that movement of the voice coil 303 translates into movement of the diaphragm 301. A dust cap may be positioned above the voice coil. The voice coil 303 is disposed on and is capable of moving along a cylindrical pole piece 305. A small gap exists between the voice coil 303 and the pole piece 305. In the illustrated embodiment, the pole piece 305 is integrated with a back plate (or base) 309. Permanent magnet 311 provides the static magnetic field in which the voice coil 303 moves. The magnet 311 is a substantially annular device with a central opening of sufficient diameter to accommodate the pole piece 305.

A front plate 313 is disposed on the magnet 311, so that the magnet 311 is located between the back plate 309 and the front plate 313. The front plate 313 is also substantially annular in shape with a central opening of sufficient diameter to accommodate the pole piece 305. The central opening of the front plate 313 is slightly smaller than the central opening of the magnet 311, so that the gap between the front plate 313 and the pole piece 305 is smaller than the gap between the magnet 311 and the pole piece 305. The front plate 313 may be made from a magnetic material, i.e., material with high magnetic permeability, such as iron, certain other metals, and alloys of iron and/or other metals. This list is not exclusive. The pole piece 305 may also be made from magnetic material, for example, the same material as the front plate 313. In an example, the pole piece 305 may be a hollow cylindrical pole. Thus, the flux of the static magnetic field emanated by the magnet 311 is focused (concentrated) in the gap between the front plate 313 and the pole piece 305. The voice coil 303, and particularly the portion of the voice coil 303 with the wire windings, can move along the pole piece 305 in the gap between the front plate 313 and the pole piece 305. The voice coil 303 moves out (up, as shown in FIG. 4) and in (down, as shown in FIG. 4) under influence of Lorentz electromotive forces created by the interaction of the static magnetic field within the gap and the variable current flowing through the windings of the voice coil 303. The movement of the voice coil 303 is transferred in a substantially linear manner to the diaphragm 301 through the diaphragm's neck area, which is attached to the former of the voice coil 305. Movement of the diaphragm 301 generates and radiates sound waves in response to the variations in the current driving the wire windings of the voice coil 303. Resonances of the diaphragm 301 are terminated or reflected at the neck area.

In addition to the flared conical shape of the diaphragm 301 shown in FIG. 3, the diaphragm may assume various other shapes. In some embodiments, for example, the diaphragm 301 is an exponential flare or has a straight-sided conical shape. The diaphragm 301 may be made from various materials, as desired for specific performance characteristics and cost tradeoffs of the transducer 300. In some examples, the diaphragm 301 is made from paper, composite materials, plastic, aluminum, and combinations of these and other materials.

An annular spider 315 is attached at its outer periphery to a middle portion of a frame 317. The inner periphery of the spider 315 is attached to the upper end of the voice coil 303, below the diaphragm 301. In this way, the spider 315 provides elastic support for the voice coil 303, aligning and centering the voice coil 303 on the pole piece 305 in both radial and axial directions. The spider 315 may be made from flexible material that can hold the voice coil 303 in place when it is not driven by an electric current, and also allow the voice coil 303 to move up and down under influence of the electromotive force when the voice coil 303 is driven by an electric current. In an example, the spider 315 is made from multi-layered fabric. Other suitable materials may also be used, e.g., including flexible polymers, rubber and the like.

The frame 317, otherwise known as a "chassis" or "basket," is used for attaching various components of the transducer 300, including the spider 315. The frame 317 also supports the transducer 300 for mounting in a baffle. It may be made from metal, polymer, or another material with sufficient structural rigidity. In an example, the frame 317 and front plate 313 are held together with bolts, while the front plate 313 and back plate 309 are attached to the magnet 311 with adhesive, e.g., glue or epoxy. In an example, all these components are attached with adhesive or with one or more bolts. Other suitable attachment methods and combinations of methods may also be used for attaching these components to each other. An outer roll seal 319 connects the outer periphery of the diaphragm 301 to an upper lip of the frame 317. The outer roll seal 319 is flexible to allow limited movement of the outer periphery of the diaphragm 301 relative to the frame 317. The dimensions of the outer seal 319 are such that it allows sufficient movement to accommodate the designed peak-to-peak excursion of the diaphragm 301 and the voice coil 303. In cross-section, the outer seal 319 may be arch-like, for example, semi-circular semi-ovoid, or folded. It should be noted, however, that the present disclosure is not necessarily limited to transducers with outer seals having arch-like cross-sections, but may include transducers with sinusoidal-like and other outer seal cross-sections and shapes. The material of the outer seal 319 may be chosen to terminate or dampen unwanted resonances in the diaphragm 301. The outer seal 319 may be made, for example, from flexible plastic, e.g., elastomeric material, multi-layered fabric, impregnated fabric, or another material.

An acoustic lens assembly is not shown in FIGS. 3-4 to illustrate the parts of the loudspeaker part 300. It will be understood that an acoustic lens may be positioned centrally in the diaphragm 301 as described herein.

Figure 5:
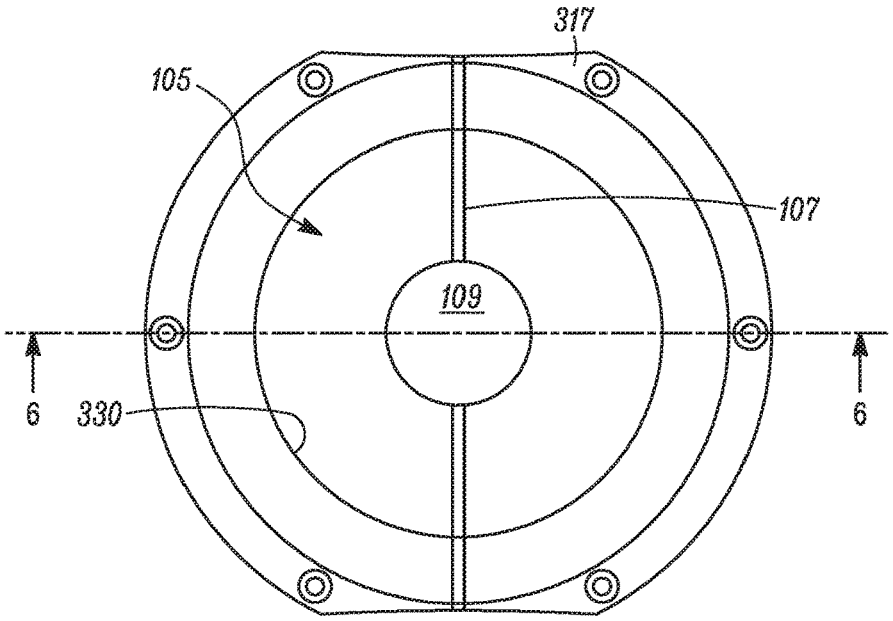
FIG. 5 depicts a front view of a loudspeaker in accordance to an embodiment.
Figure 6:
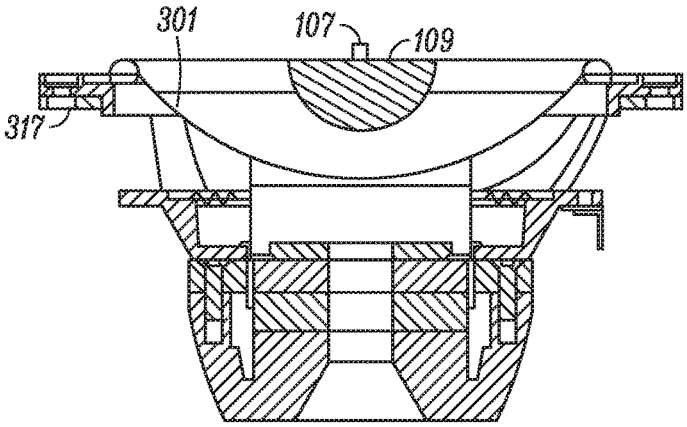
FIG. 6 depicts a cross sectional view taken generally along line 6-6 of FIG. 5 in accordance to an embodiment.

FIG. 5 depicts a front view of a loudspeaker part 300, with the lens assembly 105 added to the transducer 300. FIG. 6 depicts a cross sectional view of the loudspeaker part 300 and lens assembly 105. The lens assembly 105 positioned acoustically outwardly from the diaphragm 301. Outwardly may refer to the direction of sound waves being produced by the loudspeaker. Outwardly may also refer to the front face of the loudspeaker. The acoustic lens assembly 105 includes an acoustic lens 109 positioned above (as shown in FIG. 6) suspended in place by the support 107. The lens 109 can include a flat top surface that may be co-planar with the outer surface of the diaphragm 301 or the transducer 300. The lens 109 can substantially fills a cavity 330 defined by the volume below the outer periphery of the diaphragm 310 down to the apex of the diaphragm. By substantially filling the cavity 330, the acoustic lens 109 reduces distortions in the audio response of the transducer 300. The lens support 107 extends from the lens 109 to the frame 317 to position and support the lens 109 in the cavity 330. The lens support 107 is acoustically transparent and is to have negligible effect on the acoustic performance of the transducer 300. In an example, lens support 107 includes a narrow arm that extend from at least one connection to the frame 317 to the lens 109. In an example, the lens support 107 includes at least two arms or a $2^N$ arms. In an example, the lens support may be a mesh that has greater than 50% open space to allow sound waves therethrough while supporting the lens 109. The lens support 107 may extend along the outer opening of the cavity 330 at the outer end of the diaphragm 301 or the frame 317.

The acoustic lens 109 may be positioned co-axially with the electromagnetic components of the transducer 300 and the diaphragm 301. A top surface of the acoustic lens 109 may be coplanar with the outer surface of the diaphragm 301 or the frame 317. The bottom surface of the acoustic lens 109 is recessed into the cavity 330 but does not extend into the cavity 330 such that it interferes with the mechanical travel of the diaphragm 301 or the pole 305. In an example, the top surface is essentially planar. The bottom surface of the acoustic lens 109 is bowl shaped from the top surface. The outer dimension of the acoustic lens 109 extends radially outwardly past the pole 305 and covers the transition from the pole to the diaphragm 301. The bottom surface is arcuate or rounded. In an example, the bottom surface does not have any right angles. In an example, the bottom surface is free from planar surfaces. A body of the acoustic lens 109 may be made of any appropriate acoustically damped material and may be solid or hollow, smooth or rough, soft or hard, or with continuous or discontinuous surfaces, or combinations thereof.

The shape of the acoustically opaque lens 109 may be such that the lens 109 clears the moving parts of the transducer 300. In an example, the lens 109 may minimize (e.g., reduces) diffraction of sound energy. In an example, the lens 109 extends forward approximately to the plane defined by the outer periphery of the diaphragm 301 when the voice coil 303 is at rest. The acoustic lens 109 may extends radially outward above the central radiating area of the diaphragm 701 so as to obscure the center portion of the diaphragm. The lens 109 may acoustically block sound from being emitted directly from the center of the diaphragm 301. The lens 109 may further visually obscure center part of the loudspeaker or transducer 300.

Figure 7:
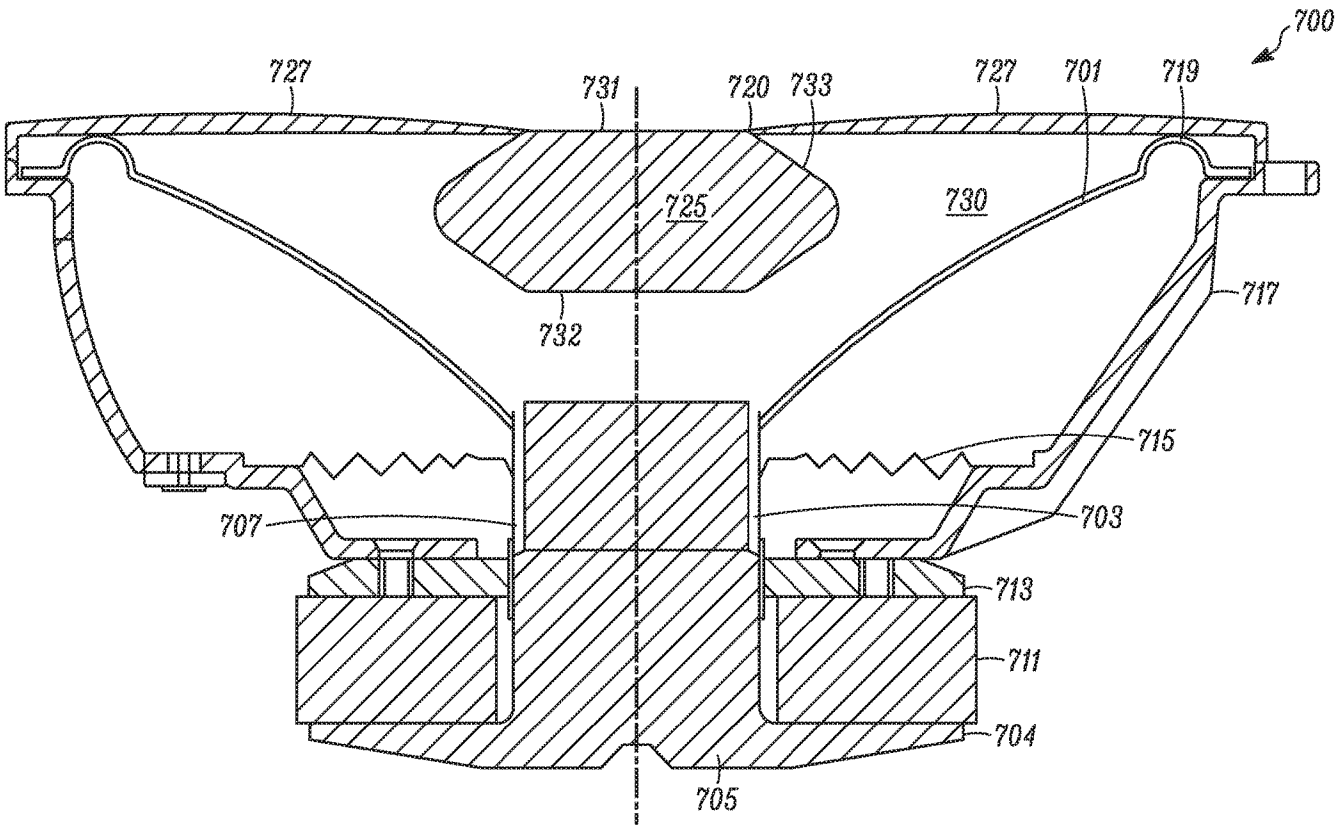
FIG. 7 depicts a cross sectional view of a loudspeaker with lens assembly in accordance to an embodiment.

The acoustically opaque lens 109 may include a first surface and a second surface that unite to form an edge to define a perimeter. The first surface, the second surface and the perimeter do not extend outwardly past the diaphragm. The first surface may face outwardly of the acoustic emitter, e.g., a loudspeaker. The second surface may face inwardly of toward the acoustic emitter. The surfaces and the perimeter are curved such that they do not have any sharp corners, which may create reflections. The lens defines an opening or an an effective aperture outside the perimeter of the lens to allow sound waves to emit from the speaker assembly FIG. 7 depicts a cross sectional view of a loudspeaker part 700, e.g., an electrodynamic acoustic transducer. The transducer 700 includes a diaphragm 701 attached at the periphery of its center opening to a voice coil 703, so that movement of the voice coil 703 translates into movement of the diaphragm 701. The voice coil 703 is disposed on and is capable of moving along a cylindrical pole piece 705. A small gap 707 exists between the voice coil 703 and the pole piece 705. In the illustrated embodiment, the pole piece 705 is integrated with a back plate (or base) 709. Permanent magnet 711 provides the static magnetic field in which the voice coil 703 moves. The magnet 711 is a substantially annular device with a central opening of sufficient diameter to accommodate the pole piece 705.

A front plate 713 is disposed on the magnet 711, so that the magnet 711 is located between the back plate 709 and the front plate 713. The front plate 713 is also substantially annular in shape with a central opening of sufficient diameter to accommodate the pole piece 705. The central opening of the front plate 713 is slightly smaller than the central opening of the magnet 711, so that the gap between the front plate 713 and the pole piece 705 is smaller than the gap between the magnet 711 and the pole piece 705. The front plate 713 may be made from a magnetic material, i.e., material with high magnetic permeability, such as iron, certain other metals, and alloys of iron and/or other metals. This list is not exclusive. The pole piece 705 may also be made from magnetic material, for example, the same material as the front plate 713. Thus, the flux of the static magnetic field emanated by the magnet 711 is focused (concentrated) in the gap between the front plate 713 and the pole piece 705. The voice coil 703, and particularly the portion of the voice coil 703 with the wire windings, can move along the pole piece 705 in the gap between the front plate 713 and the pole piece 705. The voice coil 703 moves out (up, as shown in FIG. 7) and in (down, as shown in FIG. 7) under influence of Lorentz electromotive forces created by the interaction of the static magnetic field within the gap and the variable current flowing through the windings of the voice coil 703. The movement of the voice coil 703 is transferred in a substantially linear manner to the diaphragm 701 through the diaphragm's neck area, which is attached to the former of the voice coil 705. Movement of the diaphragm 701 generates and radiates sound waves in response to the variations in the current driving the wire windings of the voice coil 703. Resonances of the diaphragm 701 are terminated or reflected at the neck area.

In addition to the flared conical shape of the diaphragm 701 shown in FIG. 7, the diaphragm may assume various other shapes. In some embodiments, for example, the diaphragm 701 is an exponential flare or has a straight-sided conical shape. The diaphragm 701 may be made from various materials, as desired for specific performance characteristics and cost tradeoffs of the transducer 700. In some examples, the diaphragm 701 is made from paper, composite materials, plastic, aluminum, and combinations of these and other materials.

An annular spider 715 is attached at its outer periphery to a middle portion of a frame 717. The inner periphery of the spider 715 is attached to the upper end of the voice coil 703, below the diaphragm 701. In this way, the spider 715 provides elastic support for the voice coil 703, aligning and centering the voice coil 703 on the pole piece 705 in both radial and axial directions. The spider 715 may be made from flexible material that can hold the voice coil 703 in place when it is not driven by an electric current, and also allow the voice coil 703 to move up and down under influence of the electromotive force when the voice coil 703 is driven by an electric current. In an example, the spider 715 is made from multi-layered fabric. Other suitable materials may also be used.

The frame 717, otherwise known as a "chassis" or "basket," is used for attaching various components of the transducer 700, including the spider 715. The frame 717 also supports the transducer 700 for mounting in a baffle. It may be made from metal, polymer, or another material with sufficient structural rigidity. In an example, the frame 717 and front plate 713 are held together with bolts, while the front plate 713 and back plate 709 are attached to the magnet 711 with adhesive, e.g., glue or epoxy. In an example, all these components are attached with adhesive or with one or more bolts. Other suitable attachment methods and combinations of methods may also be used for attaching these components to each other. An outer roll seal 719 connects the outer periphery of the diaphragm 701 to an upper lip of the frame 717. The outer roll seal 719 is flexible to allow limited movement of the outer periphery of the diaphragm 701 relative to the frame 717. The dimensions of the outer seal 719 are such that it allows sufficient movement to accommodate the designed peak-to-peak excursion of the diaphragm 701 and the voice coil 703. In cross-section, the outer seal 719 may be arch-like, for example, semi-circular semi-ovoid, or folded. It should be noted, however, that the present disclosure is not necessarily limited to transducers with outer seals having arch-like cross-sections, but may include transducers with sinusoidal-like and other outer seal cross-sections and shapes. The material of the outer seal 719 may be chosen to terminate or dampen unwanted resonances in the diaphragm 701. The outer seal 719 may be made, for example, from flexible plastic, e.g., elastomeric material, multi-layered fabric, impregnated fabric, or another material.

An acoustic lens assembly 720 is positioned acoustically outwardly from the diaphragm 701. The acoustic lens assembly 720 includes an acoustic lens 725 positioned above (as shown in FIG. 7) the pole piece 705 and substantially fills a cavity 730 defined by the volume below the outer periphery of the diaphragm 310 down to the pole piece. By filling the cavity 730, the acoustic lens 725 reduces distortions in the audio response of the transducer 700. A lens support 727 extends from the lens 725 to the frame 717 to position and support the lens in the cavity 730. The lens support 727 is acoustically transparent and is to have negligible effect on the acoustic performance of the transducer 700. In an example, lens support 727 includes a narrow arm that extends from at least one connection to the frame 717 to the lens 725. In an example, the lens support 727 includes at least two arms or a $2^N$ arms. In an example, the lens support 725 is a mesh that has greater than 50% open space to allow sound waves therethrough while supporting the lens 725. The lens support 727 may extend along the outer opening of the cavity 730 at the outer end of the diaphragm 701 or the frame 717.

The acoustic lens 725 may be positioned co-axially with at least one of the pole 705, the magnet 711, and the diaphragm 701. The top surface 731 of the acoustic lens 725 may be coplanar with the outer surface of the diaphragm 701 or the frame 717. The bottom surface 732 of the acoustic lens 725 is recessed into the cavity 730 but does not extend into the cavity 730 such that it interferes with the mechanical travel of the diaphragm 701 or the pole 705. In an example, the top surface 731 and the bottom surface 732 are essentially planar. The side surface 733 of the acoustic lens 725 extends radially outwardly past the pole 705 and covers the transition from the pole to the diaphragm 701. The side surface 733 is arcuate or rounded. In an example, the side surface does not have any right angles. In an example, the side surface 733 is free from planar surfaces. A body of the acoustic lens 725 may be made of any appropriate acoustically damped material and may be solid or hollow, smooth or rough, soft or hard, or with continuous or discontinuous surfaces, or combinations thereof.

The shape of the acoustically opaque lens 725 may be such that the lens 725 clears the moving parts of the transducer 700; minimizes (reduces) diffraction of sound energy; extends forward approximately to the plane defined by the outer periphery of the diaphragm 701 when the voice coil 703 is at rest. The acoustic lens 725 may extends radially outward above the central radiating area of the cone so as to obscure the center portion of the diaphragm.

The speaker 100, 300 operates to emit certain wavelengths of sound, which each has different path lengths. The sound is produced by movement of the coil and the diaphragm. The acoustic lens 109, 725 being positioned in front of the diaphragm in a resonant cavity. The resonant cavity is formed by the loudspeaker diaphragm of the acoustic emitter. The acoustic lens can block destructive audio interference that may be formed by differing acoustical path lengths across the loudspeaker diaphragm.

Figure 8:
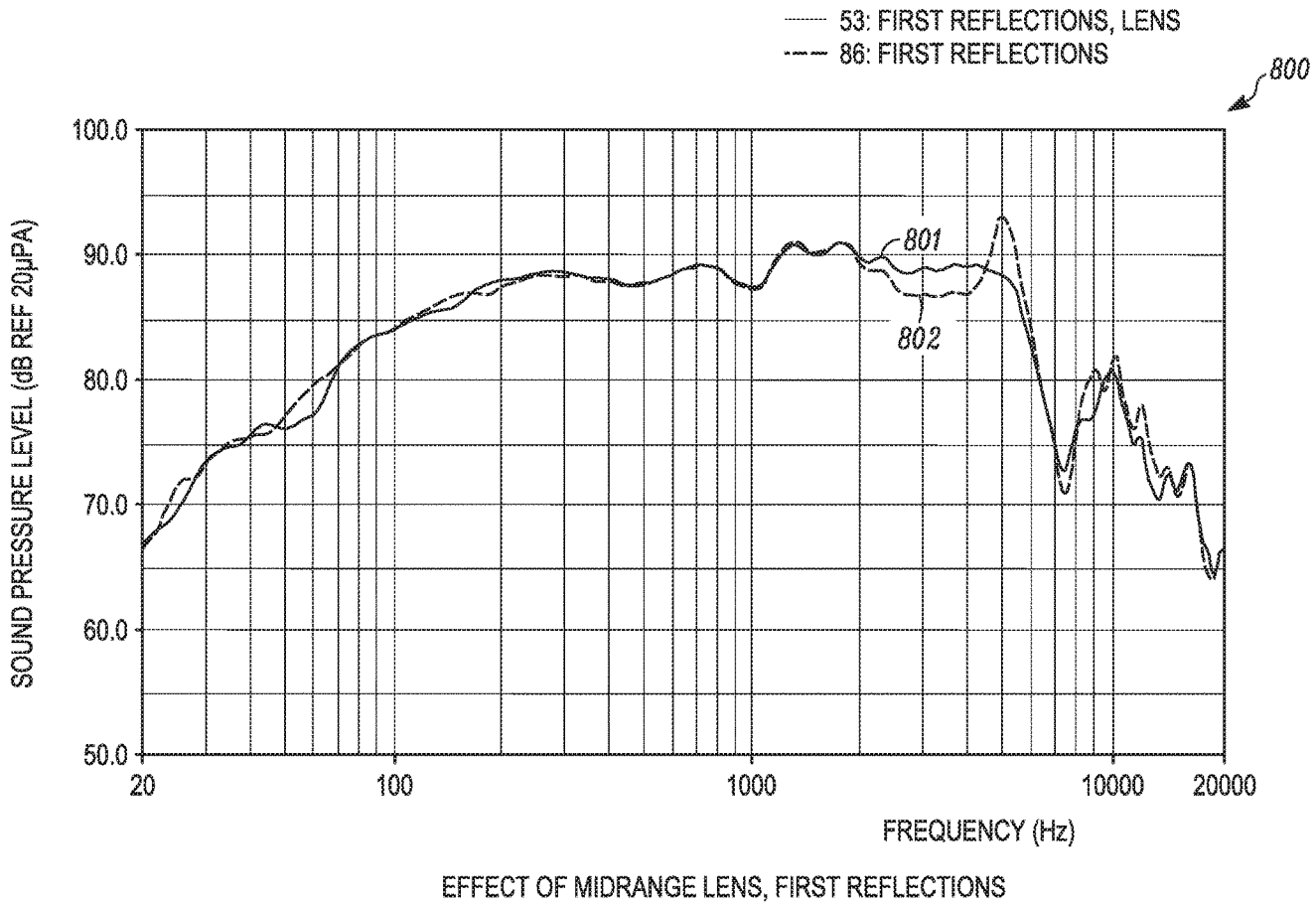
FIG. 8 depicts a graph showing the effect of the midrange lens on first reflections in accordance to an embodiment.

FIG. 8 depicts a graph 800 showing the effect of the acoustically opaque lens on first reflections. A first reflection is the measure of a sound wave after it reflects off a first surface. Frequency is shown on the abscissa in a logarithmic scale. The ordinate is sound pressure level (SPL) at a dB ref 20 μPA scale. The sound pressure level at a first reflection as a function of frequency with the lens is shown in solid line at 801. The sound pressure level as a function of frequency without the lens is shown in broken line at 802. As shown at about 2-3 KHZ, the SPL 802 without the lens experiences a dip and a spike in SPL. The SPL 801 shows a smoother response without the dip or spike. At lesser frequencies, SPL 802 closely matches the SPL 801, particularly, at frequencies at which the midrange transducer is operating. Thus, the acoustic lens creates a better SPL frequency response.

Figure 9:
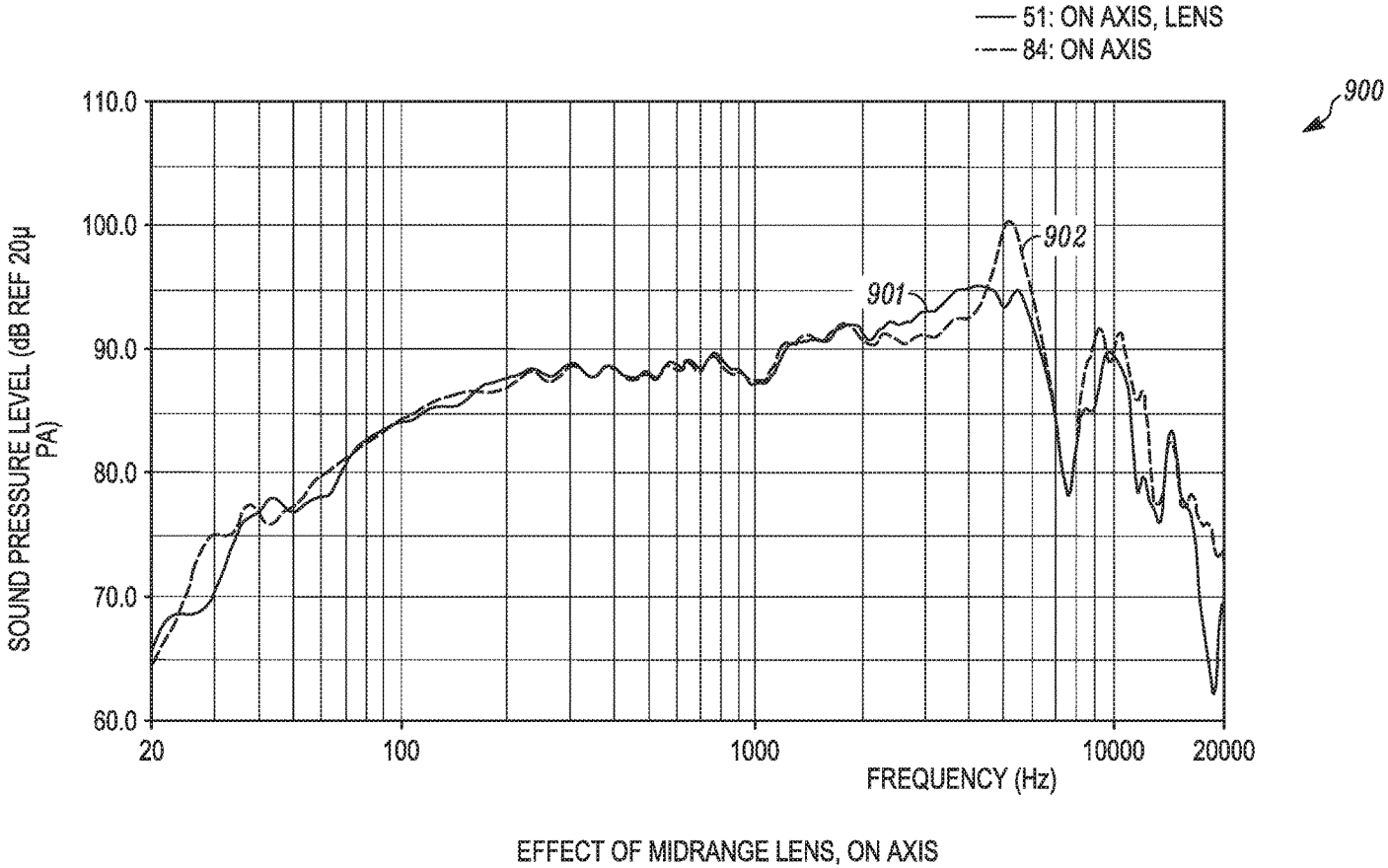
FIG. 9 depicts a graph showing the effect of the midrange lens on sound pressure level on-axis of the loudspeaker in accordance to an embodiment.

FIG. 9 depicts a graph 900 showing the effect of the midrange lens on sound pressure level on-axis of the loudspeaker. Frequency is shown on the abscissa in a logarithmic scale. The ordinate is sound pressure level (SPL) at a dB ref 20 μPA scale. The sound pressure level on axis as a function of frequency with the lens is shown in solid line at 901. The sound pressure level as a function of frequency without the lens is shown in broken line at 902. As shown at about 2-3 KHZ, the SPL 902 without the lens experiences a spike in SPL. The SPL 901 shows a smoother response without the dip or spike. At lesser frequencies, SPL 902 closely matches the SPL 901, particularly, at frequencies at which the midrange transducer is operating. Thus, the acoustic lens creates a better SPL frequency response.

Figure 10:
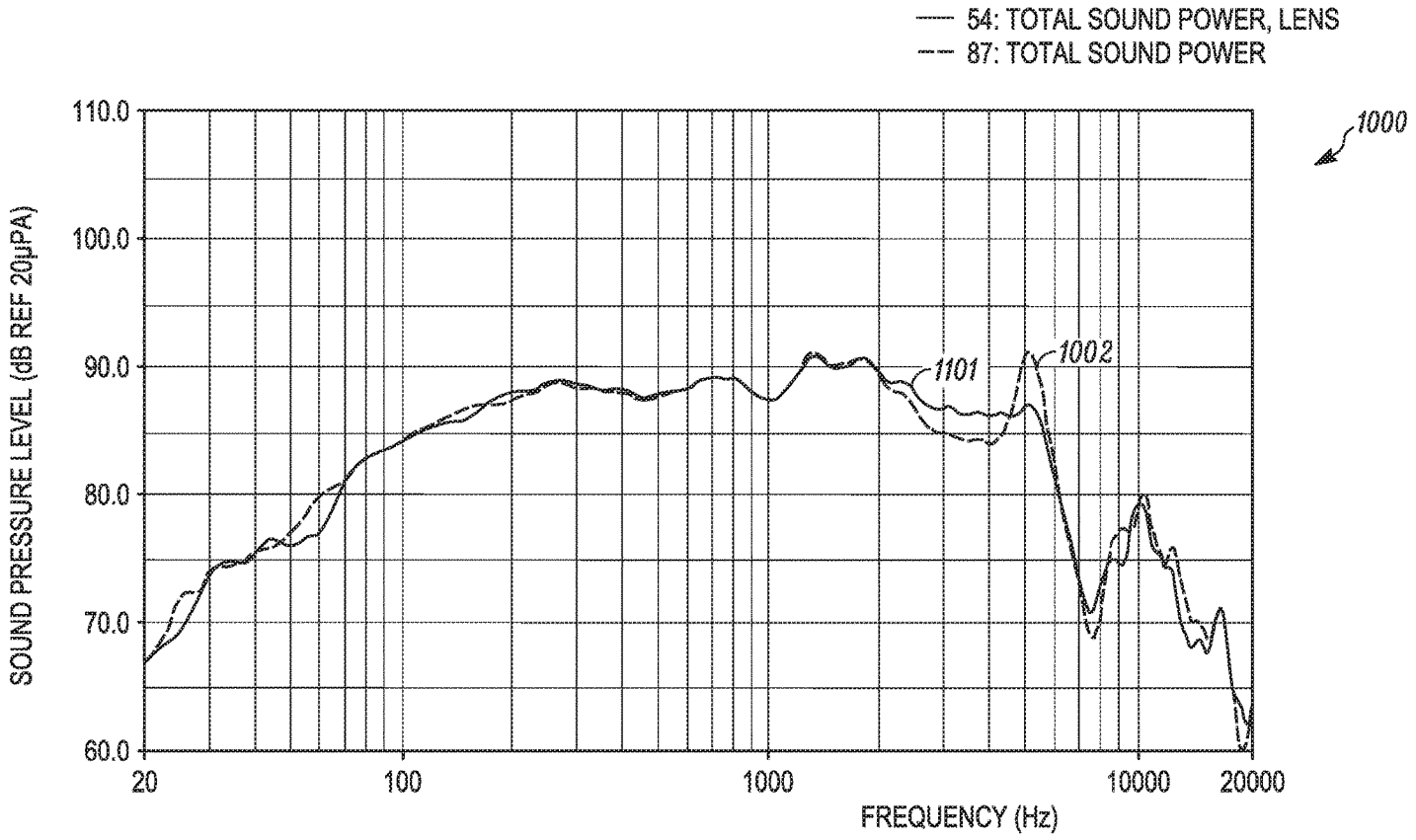
FIG. 10 depicts a graph showing the effect of the midrange lens on sound power in accordance to an embodiment.

FIG. 10 depicts a graph 1000 showing the effect of the midrange lens on sound power. Frequency is shown on the abscissa in a logarithmic scale. The ordinate is sound pressure level (SPL) at a dB ref 20 μPA scale. The sound pressure level as a function of frequency with the lens is shown in solid line at 1001. The sound pressure level as a function of frequency without the lens is shown in broken line at 1002. As shown at about 2-3 KHZ, the SPL 1002 without the lens experiences a dip and then a spike in SPL. The SPL 1001 shows a smoother response without the dip or spike. At lesser frequencies, SPL 1002 closely matches the SPL 1001, particularly, at frequencies at which the midrange transducer is operating. Thus, the acoustic lens creates a better SPL frequency response.

Figure 11:
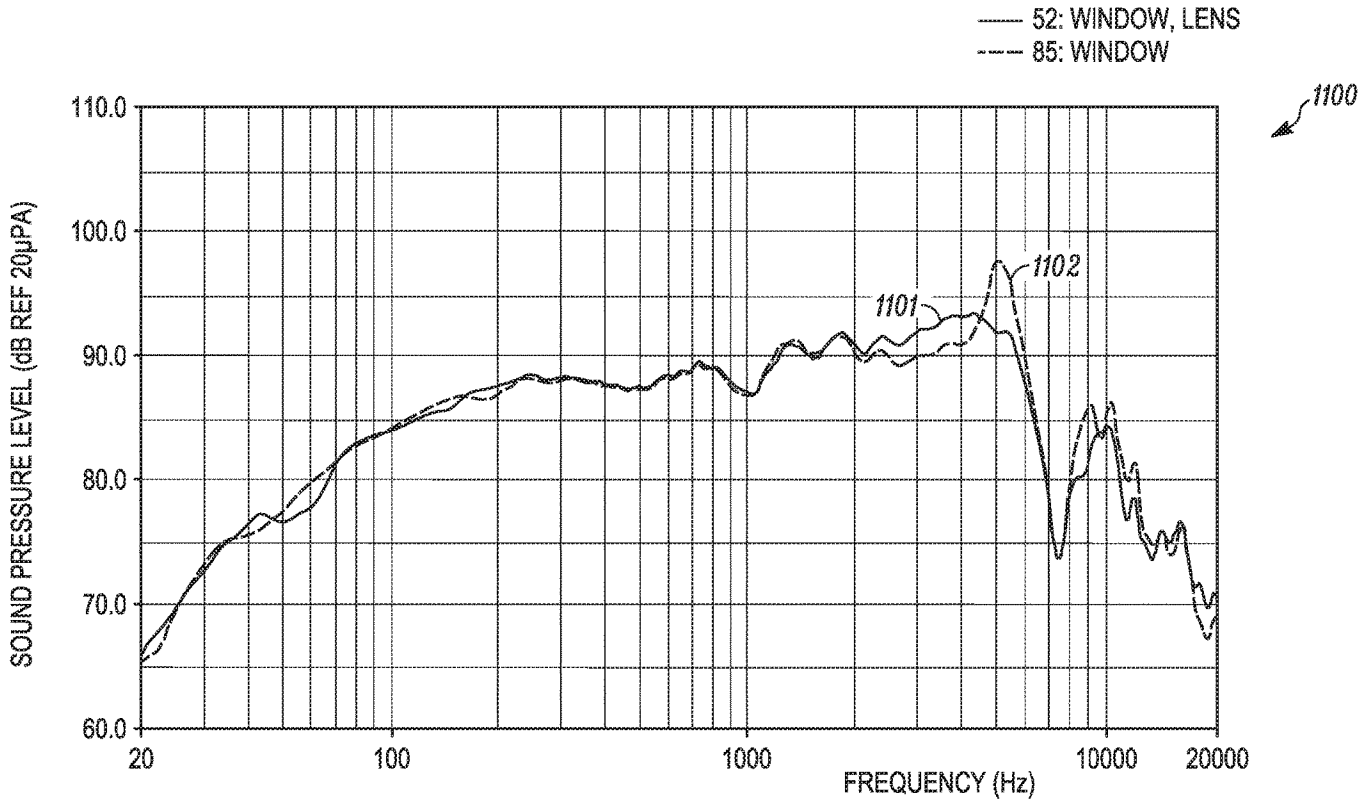
FIG. 11 depicts a graph showing the effect of the midrange lens on window in accordance to an embodiment.

FIG. 11 depicts a graph showing the effect of the midrange lens on window. Frequency is shown on the abscissa in a logarithmic scale. The ordinate is sound pressure level (SPL) at a dB ref 20 μPA scale. The sound pressure level as a function of frequency with the lens is shown in solid line at 1101. The sound pressure level as a function of frequency without the lens is shown in broken line at 1102. As shown at about 2-3 KHZ, the SPL 1102 without the lens experiences a dip and then a spike in SPL. The SPL 1101 shows a smoother response without the dip or spike. At lesser frequencies, SPL 1102 closely matches the SPL 1101, particularly, at frequencies at which the midrange transducer is operating. Thus, the acoustic lens creates a better SPL frequency response.

The above graphs 800-1100 can be reproduced using a transducer 102, 104 as shown in FIG. 1.

The present lens assembly can be used in loudspeakers that may be part of or used with vehicles, mobile electronic devices, e.g., a headphones, speakers, tablets and the like, home audio equipment, professional audio equipment, public address systems and the like.

A lens assembly is described that is positioned in the cone of the loudspeaker to improve loudspeaker performance. The lens assembly includes an acoustically opaque, acoustic lens and a support that holds the acoustically opaque lens in place above the transducer or driver. In an example, the support is essentially acoustically transparent. In an example, the lens assembly is positioned in the cone of a midrange driver or transducer. The front of the lens is coplanar or slightly recessed from the front face of the midrange transducer. In an example, support extends along the front face to secure the lens in place when not being attached to the cone itself. The acoustic lens is designed to substantially fill the resonant cavity formed by loudspeaker diaphragm while simultaneously blocking destructive interference due to differing path lengths across the diaphragm, but is not so large that it reduces the acoustic output. In an example, the acoustic lens is substantially disk or cylindrical in shape with a primary axis coaxial with the transducer. In an example, the acoustic lens has a diameter of approximately ⅓ the size of the diaphragm, which results in a diameter of 30-45 mm for a midrange transducer. In an example, the acoustic lens has a first dimension, e.g., diameter or primary axis, in the range of about 25-50 mm, +/−2 mm.

In an embodiment, the acoustic lens lies wholly between the plane defined by the maximum forward excursion of the transducer and the plane defined by the most forward features of cone of the loudspeaker. The rear surface of the acoustic lens fills the cavity created by the substantially cone-shaped diaphragm to the extent possible while not interfering with the free movement of the diaphragm and while providing certain clearance to the surface defined by the diaphragm at maximum excursion so that the propagation of broadband sound from the diaphragm is not diminished.

In an embodiment, the combination of lens and support structure will present a substantially flat surface from the point of view of the adjacent drivers so to minimize diffraction effects.

The acoustic lens as shown herein has a shape, when viewed from the front of the loudspeaker, mimics that shape of the loudspeaker part or the diaphragm. The acoustic lens may have a shape that is generally circular, elliptical, etoile, estoile, triangular, or star-like, when viewed from the font. The shape of the acoustic lens may be irregular shaped. The lengths of the sides of the shapes may be identical or non-identical. The aperture may be substantially two dimensional or three dimensional. The shape of the acoustic lens may be selected based on the desired frequency response in the environment of use, e.g., a room, a vehicle or a hall. The outermost point of these shapes do not extend outwardly past the front of the loudspeaker part. The edges of the acoustic lens are not right angles and may be rounded or smooth to reduce reflection. The acoustic lens may be free of apertures therethrough such that sound waves do not travel through the lens.

The acoustic lens may act as a phase plug to improve the directional audio performance of a loudspeaker. The acoustic lens may be free of slits, slots or other apertures therein. Thus, the sound waves cannot travel within the outer perimeter of the acoustic lens. The sound waves must travel out of the loudspeaker through the gap between the centrally located acoustic lens and the outer edge of the cone or diaphragm. Application of the improved directional audio performance to a sound system in a listening area may improve the performance of the audio system. Configuration of the acoustic lens may include both symmetrical and asymmetrical features to provide an improved frequency response and directivity with the. The improved loudspeaker may provide improved an improved listing location, for example, in a vehicle.

While example embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An acoustic assembly comprising:

a loudspeaker aligned on an axis, having a diameter that intersects the axis, and including:

a frame aligned on the axis and having a front side spaced from a back side;

a diaphragm configured to move along the axis and output sound toward the front side of the frame, wherein the diaphragm angularly extends from the axis and attaches to front side of the frame, wherein the diaphragm and the front side of the frame define a front cavity;

an acoustically transparent support extending across the front side of the frame, the support including a first leg extending from a first portion of the frame to a second portion of the frame, and a second leg extends from a third portion of the frame to a fourth portion of the frame; and an acoustically opaque lens attached to each of the legs, positioned in front of the diaphragm in the front cavity, aligned on the axis, and having a diameter that intersects the axis, wherein the diameter of the lens is approximately ⅓ the diameter of the loudspeaker and the lens is configured to improve a frequency response of the loudspeaker by smoothing sound pressure level in a target frequency range.

2. The acoustic assembly of claim 1, wherein the second portion of the frame is across from the first portion, and the fourth portion of the frame is across from the third portion.

3. The acoustic assembly of claim 1, wherein the lens is attached to a middle of the first leg and a middle of the second leg such that the lens is held and spaced above the diaphragm in the front cavity.

4. The acoustic assembly of claim 3, wherein the diameter of the loudspeaker intersects the middle of the first leg and the middle of the second leg.

5. The acoustic assembly of claim 4, wherein the first leg is an arcuate shape and the second leg is an arcuate shape.

6. The acoustic assembly of claim 1, wherein the lens includes a top surface, a bottom surface, and a side surface therebetween, wherein the bottom surface is positioned in front of and spaced above the diaphragm in the front cavity.

7. The acoustic assembly of claim 6, wherein the bottom surface of the lens is positioned in the front cavity to not interfere with the diaphragm when the diaphragm travels along the axis.

8. The acoustic assembly of claim 6, wherein the top surface of the lens is coplanar with the front side of the frame.

9. The acoustic assembly of claim 6, wherein the side surface of the lens extends radially from the axis and is smoothly curved.

10. The acoustic assembly of claim 6, wherein the loudspeaker includes a pole piece that is aligned on the axis and secured to the frame, the pole piece includes a radial dimension that extends through the axis, wherein the side surface defines the diameter of the lens, wherein the diameter of the lens via the side surface is greater than the radial dimension of the pole piece.

11. The acoustic assembly of claim 1, wherein the lens is free of apertures extending therethrough and is arranged in the front cavity while simultaneously blocking destructive interference due to differing acoustical path lengths across the diaphragm.

12. An acoustic assembly comprising:

a loudspeaker aligned on an axis, having a diameter that intersects the axis, and including:

a dust cap coupled to a diaphragm;

a support including at least two legs extending across the diaphragm including a first leg extending from a first portion of the frame to a second portion of the frame, and a second leg extending from a third portion of the frame to a fourth portion of the frame, and an acoustically opaque lens attached to the legs, the lens configured to improve a frequency response of the loudspeaker by smoothing sound pressure level in a target frequency range.

13. The acoustic assembly of claim 12, wherein the support is acoustically transparent for acoustic frequencies of the loudspeaker assembly and is connected to a frame of the loudspeaker assembly.

14. The acoustic assembly of claim 13, wherein the legs hold the lens coaxially above the dust cap.

15. The acoustic assembly of claim 14, wherein the lens provides a clearance to a surface defined by the diaphragm for a maximum excursion to allow propagation of broadband sound from the diaphragm.

16. The acoustic assembly of claim 12, wherein the lens is at least partially arranged in a cavity defined by the dust cap and the diaphragm while not interfering with free movement of the diaphragm.

* * * * *